United States Patent [19]

Nakayama et al.

[11] Patent Number: 5,033,648

[45] Date of Patent: Jul. 23, 1991

[54] MIXING APPARATUS IN WHICH MIXING IS EFFECTIVELY CARRIED OUT ABOUT VARIOUS BEVERAGES SUPPLIED FROM BEVERAGE PATHS INTO A MIXING SPACE

[75] Inventors: Shunichi Nakayama, Takasaki; Yasushi Takayanagi, Akabori, both of Japan

[73] Assignee: Sanden Corporation, Japan

[21] Appl. No.: 436,243

[22] Filed: Nov. 14, 1989

[51] Int. Cl.[5] ..... B67D 5/56

[52] U.S. Cl. ..... 222/129.1; 222/132; 222/145; 222/506

[58] Field of Search ..... 222/129, 129.1, 325, 222/481.5, 505, 509, 518, 566, 145, 506

[56] References Cited

U.S. PATENT DOCUMENTS

| | | | |
|---|---|---|---|
| 1,261,986 | 4/1918 | White | 222/129.1 |
| 2,462,019 | 2/1949 | Bowman . | |
| 2,712,887 | 7/1955 | King . | |
| 3,168,967 | 2/1965 | Giampa | 222/129.1 |
| 3,215,312 | 11/1965 | Guzzi . | |
| 3,348,737 | 10/1967 | Yingst et al. . | |
| 3,863,810 | 2/1975 | Hanson | 222/129.1 |
| 4,304,736 | 12/1981 | McMillin et al. . | |
| 4,493,441 | 1/1985 | Sedam et al. . | |
| 4,555,371 | 11/1985 | Jeans . | |
| 4,649,809 | 3/1987 | Kanezashi . | |
| 4,688,701 | 8/1987 | Sedam . | |
| 4,804,112 | 2/1989 | Jeans . | |
| 4,836,414 | 6/1989 | Credle, Jr. et al. . | |
| 4,863,068 | 9/1989 | Smith | 222/129.1 |
| 4,932,564 | 6/1990 | Austin et al. | 222/129.1 |

*Primary Examiner*—Kevin P. Shaver

*Attorney, Agent, or Firm*—Banner, Birch, McKie & Beckett

[57] ABSTRACT

In an apparatus for providing a mixed beverage which is made of various beverages in a mixing space extending along a predetermined axis, the beverages are supplied to the mixing space so that a selected one of the beverages is discharged to a particular portion on the predetermined axis and that another one of the beverages is discharged to a specific portion around the predetermined axis. As a result, the selected beverage is substantially enveloped in the other beverage in the mixing space. Therefore, mixing is effectively carried out about the beverages. It is a matter of course that the beverages are discharged as the mixed beverage from the mixing space.

6 Claims, 5 Drawing Sheets

MIXING APPARATUS IN WHICH MIXING IS EFFECTIVELY CARRIED OUT ABOUT VARIOUS BEVERAGES SUPPLIED FROM BEVERAGE PATHS INTO A MIXING SPACE

BACKGROUND OF THE INVENTION

This invention relates to a mixing apparatus which is for mixing various beverages and which is included in, for example, a dispensing unit for dispensing a beverage, such as a syrup or the like.

Various dispensing units of the type are already known. For example, a dispensing unit as a post-mixed beverage dispenser is disclosed in U.S. Pat. Nos. 4,493,441 and 4,688,701 issued to Jason K. Sedam et al and assigned to The Coca-Cola Company. The dispensing unit is for dispensing a beverage contained in a bottle which is well known in the art.

A conventional dispensing unit may be provided with a mixing apparatus for mixing an original beverage with another original beverage. The mixing apparatus comprises a nozzle of a cylindrical member defining a mixing space. The original beverages are supplied from beverage paths into the nozzle to thereby be mixed in the mixing space with one another. It is a matter of course that the beverages are discharged from the nozzle as a mixed beverage after mixing of the original beverages.

However, it will be assumed that the mixing is not sufficiently carried out about the original beverages in the nozzle.

SUMMARY OF THE INVENTION

It is therefore an object of the present invention to provide a mixing apparatus in which mixing is effectively carried out about various beverages supplied from beverage paths into a mixing space.

Other objects of this invention will become clear as the description proceeds.

According to this invention, there is provided a mixing apparatus for providing a mixed beverage made of a first and a second beverage which are supplied from a first and a second path, respectively. The mixing apparatus comprises defining, first guiding, second guiding, and discharging means. The defining means or mixing chamber has an inner surface for defining a mixing space extending along a predetermined axis. The first guiding means is coupled to the first path and is for guiding the first beverage to a particular or first portion of the mixing space to discharge the first beverage therefrom. The particular portion is on the predetermined axis. The second guiding means is coupled to the second path and is for guiding the second beverage to a specific portion of the mixing space to discharge the second beverage therefrom. The a second specific portion is around or substantially surrounds the predetermined axis. The discharging means is coupled to the defining means and is for discharging the first and the second beverages as the mixed beverage from said mixing space.

DESCRIPTION OF THE PREFERRED EMBODIMENT

Figure 1:
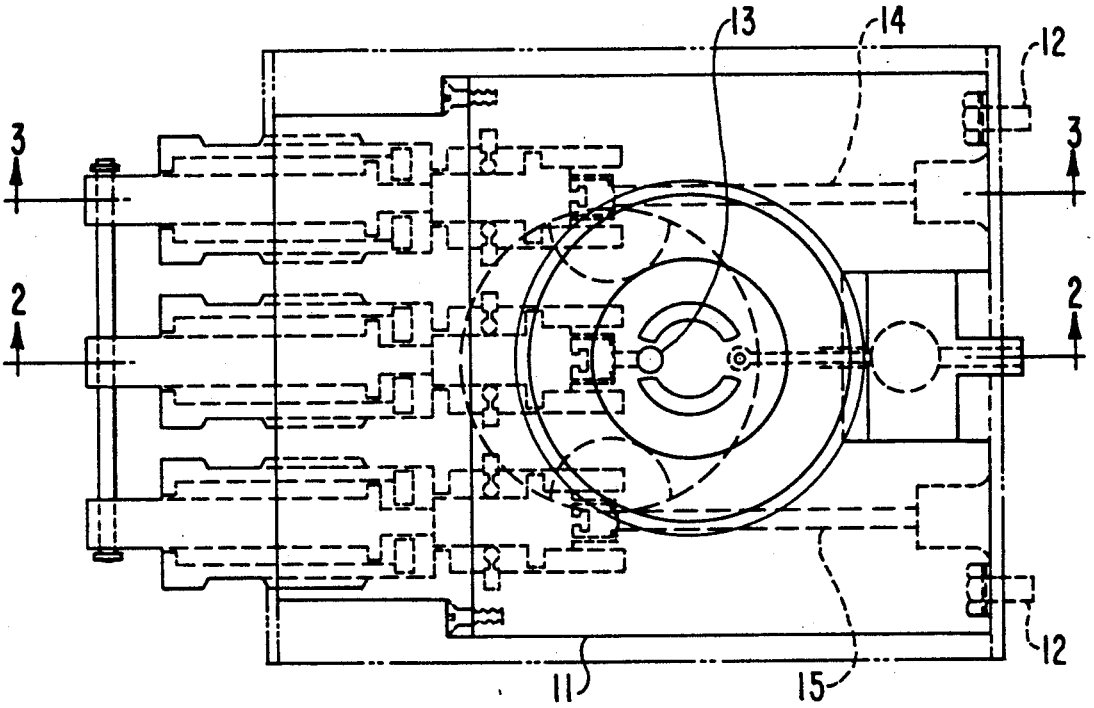
FIG. 1 is a plan view of a valve unit including a mixing apparatus according to an embodiment of this invention.

Referring to FIGS. 1 through 4, a valve unit comprising a mixing apparatus according to an embodiment of the present invention is for use in a dispensing unit which is for dispensing a beverage, such as a syrup drink diluted with dilution water and/or carbonated water in the manner known in the art. The valve unit is for use in a dispensing unit which will later be described. The valve unit comprises a body 11 which is fixed to a frame (not shown) of the dispensing unit by bolts 12 and which will be referred to as a main portion. The body 11 defines a syrup path 13 at a central position thereof and dilution water and carbonated water paths 14 and 15 which are placed at left and right sides thereof, respectively. Each of the syrup, the dilution water, and the carbonated water paths 13, 14, and 15 is referred to as a beverage path and is communicated with a nozzle 16 which is provided at a lower end of the body 11. The body 11 may be made of a combination of various parts.

The syrup path 13 has, an upper end thereof, a connecting opening 17 connected to a syrup bottle 18 which is placed on an upper portion of the body 11. The syrup bottle 18 is removable from the body 11. The bottle has an outlet portion defining a bottle opening in the manner known in the art.

The dilution water path 14 is connected to a dilution water source (not shown) through a dilution water pipe (not shown). Similarly, the carbonated water path 15 is connected to a carbonated water source (not shown). Therefore, it is possible to discharge the syrup, the dilution water, and the carbonated water through the nozzle 16.

The syrup path 13 has, between the nozzle 16 and the connecting opening 17, an intermediate portion provided with a valve mechanism 22 which is capable of opening and shutting the syrup path 13. Each of the dilution and the carbonated paths 14 and 15 is provided with another valve mechanism 23 which is similar to the valve mechanism 22.

Description will proceed to only the first-mentioned valve mechanism 22 because those valve mechanisms are similar to one another. A valve hole 11*a* is made in the body 11 to communicate with the particular portion of the syrup path 13. The valve mechanism 22 comprises valve and force transmission members 24 and 25. The valve member 24 is placed in the valve hole 11*a* to be movable in each of first and second senses 26 and 27 which are opposite to one another. The valve member 24 has a packing 28 at an end thereof in the second sense 27. The packing 28 faces the intermediate portion of the syrup path 13 and is for opening or closing the syrup path 13 with the valve member 16 moved in each of the first and the second senses 26 and 27. The valve member 24 is urged in a first sense 26 by a first compression spring 29 which is between the body 11 and the valve member 24.

A sealing member 30 is fixed to the body 11 and is in slidable contact with the valve member 24 to seal a gap 31 left therebetween. It is to be noted in this connection that FIG. 1 illustrates a case where the valve member 24 is placed at a close position at which the syrup path 13 is closed by the valve member 24.

The valve apparatus further comprises an adjusting screw 32 of a cylindrical tube which defines a through hole 32*a*. The adjusting screw 32 is screwed in a cylindrical screw hole 11*b* which is made in the body 11 to communicate with the valve hole 11*a*. Therefore, the adjusting screw 32 has a position which is adjustable in the first and the second senses 26 and 27 by rotation thereof. In addition, it is readily possible by a small force to operate the adjusting screw 32.

The force transmission member 25 is inserted in the adjusting screw 32 and extends in the first and the second senses 26 and 27 to have first and second ends 25*a* and 25*b* which extend outside of the adjusting screw 32 in the first and the second senses 26 and 27.

A second compression spring 33 is placed inside the adjusting screw 32 and is referred to as urging arrangement. The second compression spring 33 is for urging the force transmission member 25 in the second sense 27. As a result, the first end 25*a* of the force transmission member 25 is brought in press contact with the valve member 24 to push the valve member 24 towards the close position. In this connection, the second compression spring 33 has urging force which is greater than that of the first compression spring 29. Therefore, the valve member 24 is placed at an open position to open the syrup path 13 when the force transmission member 25 is not received with external force.

A stopper 34 is fixed to an axial end of the adjusting screw 32 to be movable in each of the first and the second senses 26 and 27 dependent on the adjusting screw 32. The stopper 34 is for determining the open position. At the open position, the valve member 24 is in engagement with the stopper 34 in the first sense 26. In this connection, it is a matter of course that the valve member 24 opens the syrup path 13. The open position can be moved in each of the first and the second senses 26 and 27 by rotating the adjusting screw 32. Therefore, it is possible to adjust an opening of the syrup path 13 into a desired value thereof.

The body 11 is provided with an operating lever 35 at a front surface thereof. The operating lever 35 has a middle portion rotatably supported to a supporting portion 36 through a horizontal shaft 37. A substantial end portion of the operating lever 35 is in removable engagement with a shaft 38 which is supported to the second end 25*b* of the force transmission member 25.

When the operating lever 35 is pushed as depicted at an arrow 39, the force transmission member 25 is moved in the first sense 26. In response, the valve member 24 is also moved in the first sense to open the syrup path 13. As a result, the syrup flows from the syrup bottle 18 into the syrup path 13 and then is supplied to the nozzle 16 through the water conduction member 70. In this event, movement of the operating lever 35 is detected with a detection switch 42 operated by an arm 43 which is fixed to the operating lever 35.

Although detailed description is omitted for simplification of the description, each of the dilution water and the carbonated water paths 14 and 15 comprises constitution which is similar to that of the syrup path 13. Therefore, it is possible to supply the beverage of suitable mixing among the syrup, the carbonated water, and the dilution water through the nozzle 6. It is a matter of course that concentration of the beverage may be adjusted by each adjusting screw 32.

The syrup bottle 18 is of a cassette type which is detachably attached to the body 11. $CO_2$ gas can be supplied to the syrup bottle 18 through a gas path 44 and a gas tube (not shown) connected to the gas path 44. The gas path 44 is connected to a check unit 50 which will presently be described.

The check unit 50 comprises a casing 51 fixed to the body 11 by screw members 52. The casing 51 defines a space portion 53 which extends upwardly and downwardly as a first local portion. The space portion 53 has an upper opening and a lower opening 53*a* which is closed by a cover member 54 screwed in the lower opening.

The upper opening of the space portion 53 is connected to an inlet port 56 which is for being connected to the gas tube. The space portion 53 has a lower portion communicated with the syrup bottle 18 through the gas path 44. As a result, a combination of the gas path 44 and the space portion 53 is formed in a U-shape as will become clear from FIG. 2.

The check unit 50 further comprises first and second check valves 61 and 62 which are arranged in series in the space portion of the casing 51. The first check valve 61 is placed at a high position. The second check valve 62 is placed at a low position which is lower than the high position.

The first check valve 61 comprises valve seat and valve body members 63 and 64 which are placed in the space portion 53. The valve seat member 63 is fixed to the casing 51. The valve body member 64 is held in a central portion of the valve seat member 63. A seal ring 65 is for sealing a clearance around the valve seat member 63.

The valve seat member 63 has a plurality of small through holes 66 which are arranged along a circle. Each of the small through holes 66 is for permitting the $CO_2$ gas to pass therethrough. On the other hand, the valve body member 64 is of rubber and comprises a flange portion 67 which is placed under the valve seat member 63 to face the small through holes 66. When the valve body member is moved upwardly, the flange portion 67 becomes in contact with the valve seat member 63 to thereby check an upward flow of the $CO_2$ gas. It is a matter of course that the first check valve 61 permits the $CO_2$ gas to flow downwardly.

Although detailed description is omitted for simplification of the description, the second check valve 62 comprises structure which is similar to that of the first check valve 61. A numeral 68 is representative of a filter which is well known in the art.

With this structure, a counterflow of the syrup is surely prevented by the first and the second check valves 61 and 62.

In addition, the body 11 is provided with a mixing apparatus holder 69 which is integral with a lower end thereof. The mixing apparatus holder 69 comprises tube, radial plate, cylinder, and flange parts 69*a*, 69*b*, 69*c*, and 69*d* respectively, as will presently be described.

The tube part 69*a* has a predetermined axis extending upwardly and downwardly and defines the syrup path 13. The radial plate part 69*b* radially outwardly extends from an outer peripheral surface of the tube part 69*a*. The cylindrical part 69*c* downwardly extends from an outer peripheral surface of the radial plate part 69*b* along the predetermined axis. The flange part 69*d* is integral with the cylindrical part 69c and is outwardly projected from a peripheral surface of the cylindrical part 69c.

The nozzle 16 comprises large and small diameter portions 16a and 16b respectively. The large diameter portion 16a is provided with an engaging portion 16c which is in engagement with the flange part 69d for making the nozzle 16 be held to the mixing apparatus 69. In addition, the large diameter portion 16a has an inner surface defining a mixing space S which extends along the predetermined axis. In the mixing space S, the syrup, the dilution water, and the carbonated water are mixed with one another to produce a mixed beverage. The large diameter portion 16a is referred to as a defining arrangement.

The mixed beverage is discharged through the small diameter portion 16b. Therefore, the mixed beverage is referred to as a discharging arrangement.

Figure 2:
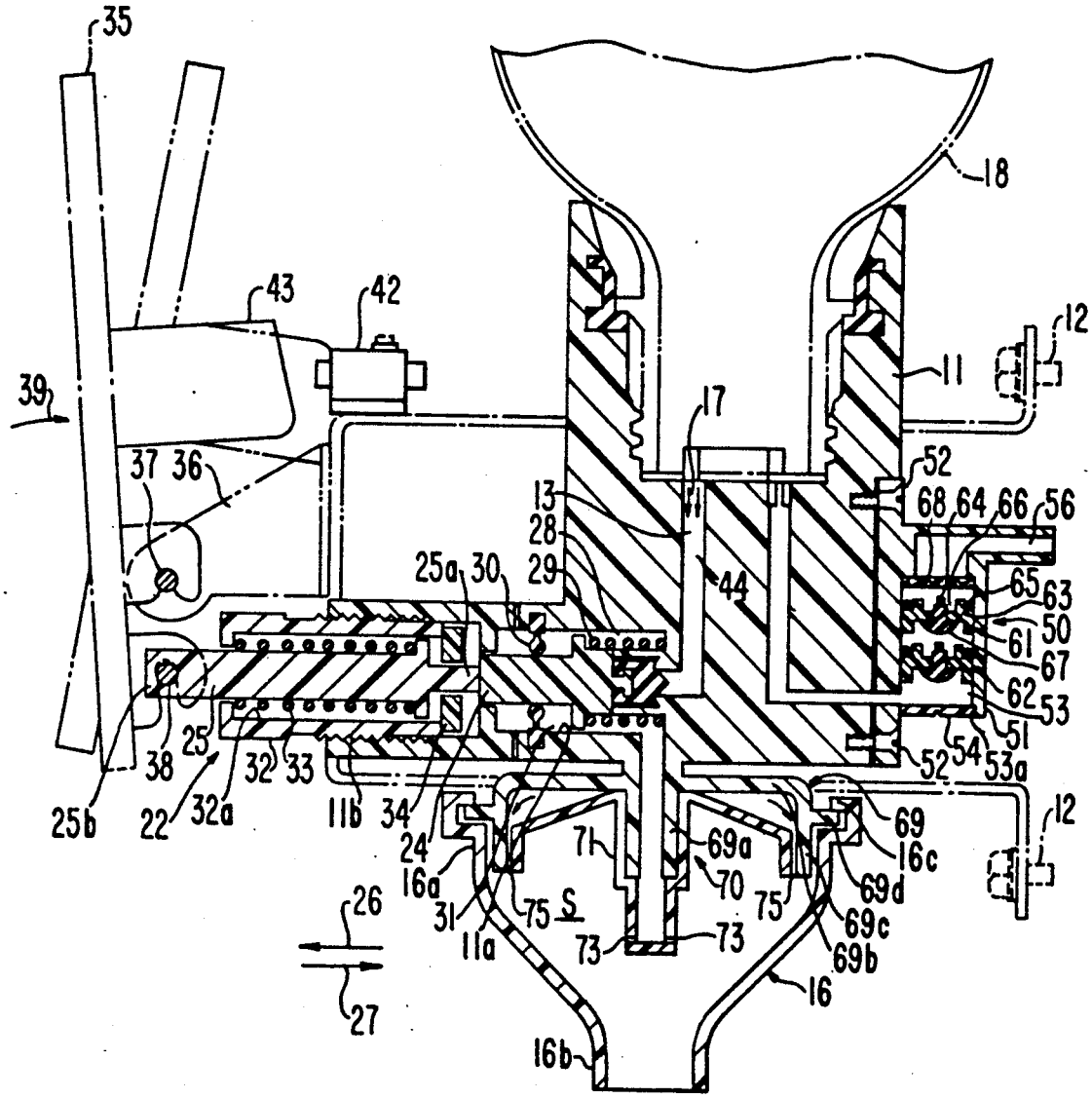
FIG. 2 is a sectional view of the valve unit taken along a line 2—2 in FIG. 1.
Figure 3:
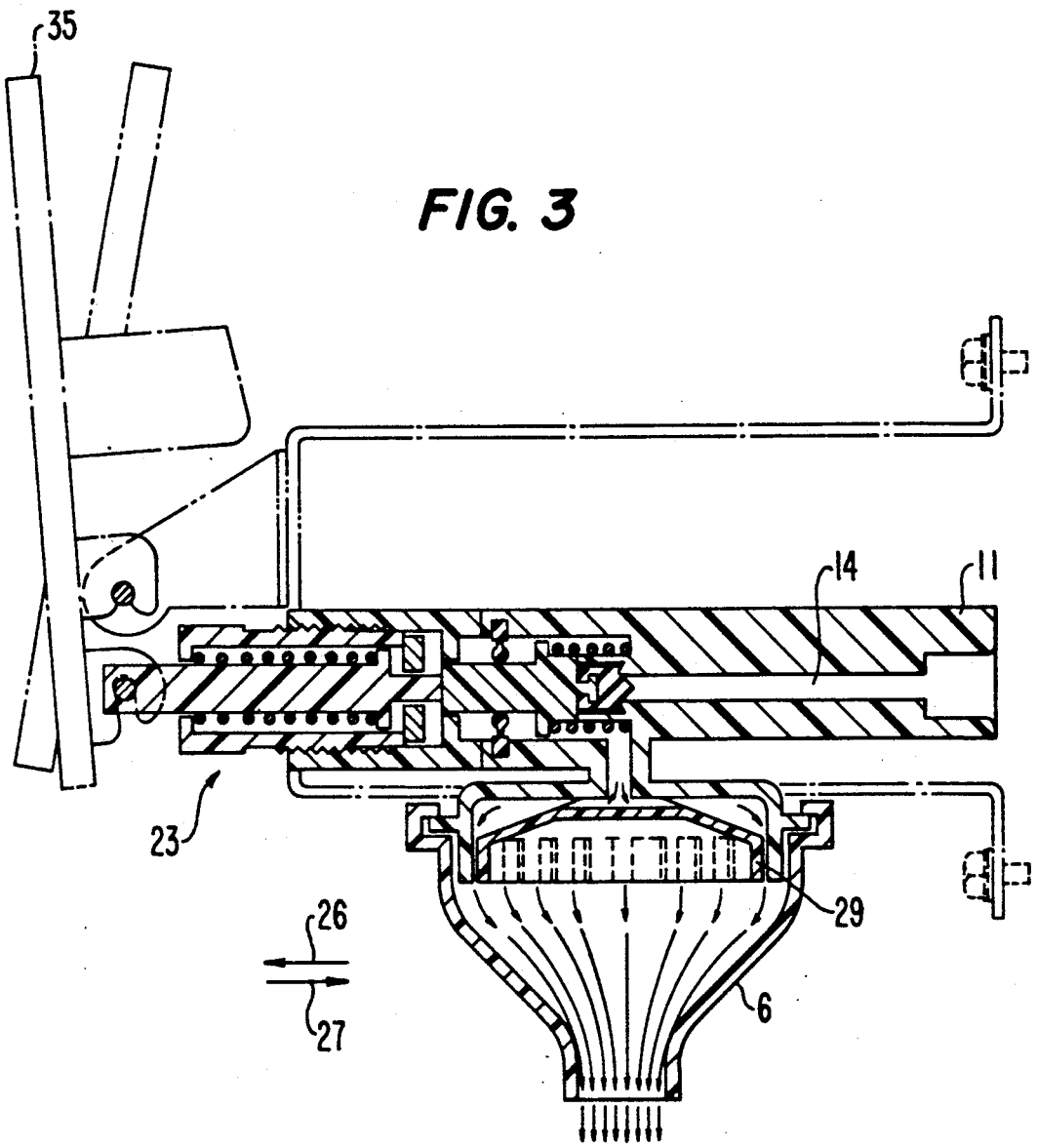
FIG. 3 is a sectional view of a part of the valve unit taken along a line 3—3 in FIG. 1.
Figure 5:
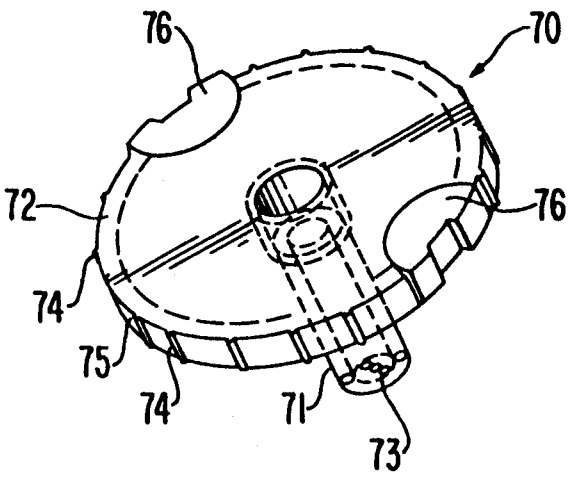
FIG. 5 is a perspective view of a water conduction member included in the valve unit of FIG. 1.
Figure 4:
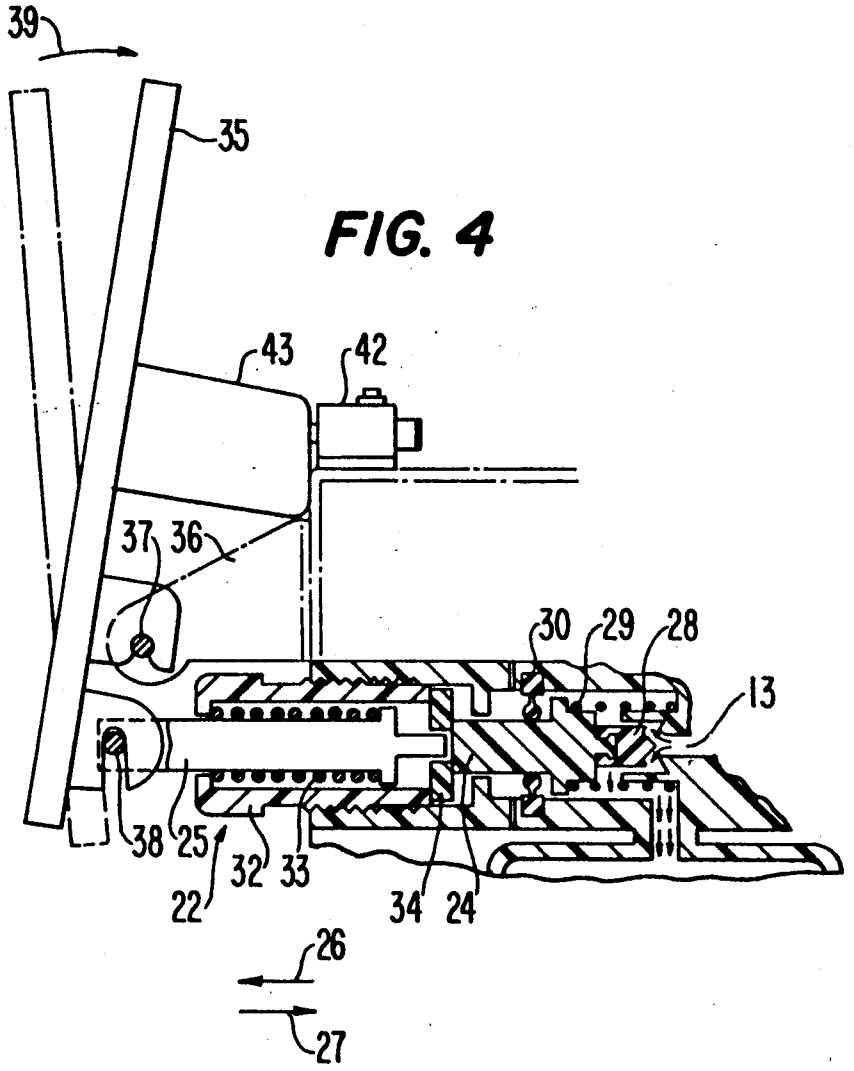
FIG. 4 is a sectional view for use in describing operation of the valve unit illustrated in FIG. 1.

Referring to FIG. 5 together with FIGS. 2 and 3, the water conduction member 70 comprises a cylindrical portion 71 of a central portion thereof, and a plate portion 72 which outwardly extends from an upper end of the cylindrical portion 71. The cylindrical portion 71 is closely fitted over the tube part 69a to communicate with the syrup path 13 and is fixed to the tube part 69a. The cylindrical portion 71 has a lower portion defining a plurality of discharging ports or holes 73 which are radially directed at vicinity of a lower end thereof. Therefore, the syrup is guided through the cylindrical portion 71 to a particular, or first portion, namely, the lower portion thereof and is then discharged inside the nozzle 16 through each of the discharging ports 73. The cylindrical portion 71 is referred to as a first guiding arrangement.

The plate portion 72 has a circular peripheral surface, which faces the inner surface of the large diameter portion 16a of the nozzle 16. A plurality of projections 74 are projected from the circular peripheral surface of the plate portion 72 with a space left between adjacent ones thereof to produce a groove 75 therebetween. The plate portion 72 is integral with a first table portion 76a and a second table portion 76b as a receiving arrangement which are placed at an upper end thereof with an angular space left therebetween. Each of the table portions 76a, 76b has an upper flat surface extending perpendicular to a predetermined direction which is parallel to the predetermined axis. A combination of the plate and the table portions 72, 76a and 76b is referred to as a second guiding arrangement.

The water conduction member 70 is fixedly placed in the nozzle 16 so that the table portions 76a, 76b face outlet ends or openings of the dilution and the carbonated paths 14 and 15, respectively.

When the dilution and the carbonated water are discharged from the outlet ends of the dilution water and the carbonated water paths, they collide with the upper flat surfaces of the table portions 76a, 76b to thereby be spread as a spread beverage in various directions. After that, the dilution and the carbonated water are guided towards a specific or second portion, namely, a periphery of the plate portion 72 and are discharged inside the nozzle 16 through the grooves 75. As a result, the syrup is enveloped in or surrounded by the dilution and the carbonated water in the nozzle 16. Therefore, mixing are favorably and effectively carried out among the syrup, the dilution water, and the carbonated water.

Figure 6:
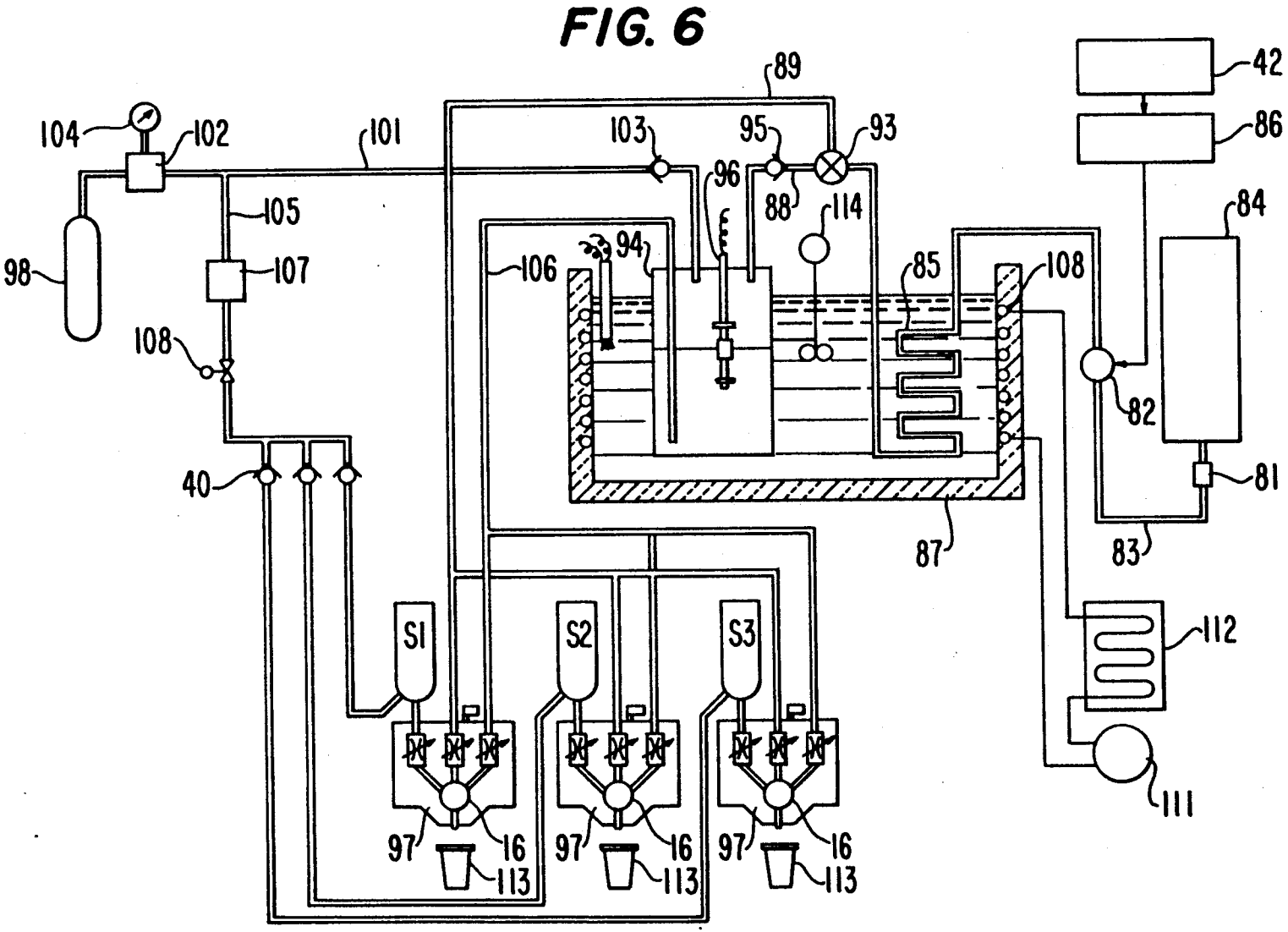
FIG. 6 is a view for use in describing a dispensing unit comprising the valve unit illustrated in FIG. 1.

Attention will be directed to the dispensing unit referring to FIG. 6. The dispensing unit comprises a coupler 81 connected to a pump 82 through a first supplying pipe 83. The coupler 81 is for removably connecting a portable tank 84 to the supplying pipe 83 and has a function in which the supplying pipe 83 is closed when the portable tank 84 is removed from the coupler 81. The portable tank 84 is for containing a drinking water.

The pump 82 is connected to an end of a refrigerant pipe 85 and has operation which is controlled by a control unit 86 with reference to operation of the detection switch 42. The refrigerant pipe 85 is passed through a refrigerant water contained in a refrigerant water tank 87. Second and third supplying pipes 88 and 89 are connected to another end of the refrigerant pipe 85 through an electromagnetic three-way-valve 93 which is well known in the art. The second supplying pipe 88 is connected to a carbonator 94 through a check valve 95. The carbonator 94 is provided with a flat switch 96 therein.

The dispensing unit further comprises three valve apparatus 97 which are similar to the above-mentioned valve apparatus shown in FIGS. 1 through 4. The third supplying pipe 89 is connected to the dilution water path 14 (FIG. 3) of each of the valve apparatus 97. More particularly, the third supplying pipe 89 is branched into a plurality of pipe portions which are connected to the valve apparatus 97, respectively.

A $CO_2$ tank 98 is connected to the carbonator 94 through a gas pipe 101. The carbonated water is produced from a drinking water and the $CO_2$ gas in the carbonator 94. The gas pipe 101 is provided with reducing and check valves 102 and 103 which are inserted thereto. The reducing valve 102 is provided with an indicator 104 which is for indicating a primary pressure of the gas pipe 101. The reducing valve 102 is for reducing a pressure of the $CO_2$ gas into 0.4 $kg/cm^2$.

A branched pipe 105 is connected to the gas pipe 101 between the reducing and the check valves 102 and 103. The branched pipe 105 extends through the reducing valve 107 and an operating cock 108 and is branched into a plurality of pipe portions which are connected to syrup tanks S1, S2, and S3, respectively. Each of the syrup tanks S1, S2, and S3 corresponds to the above-mentioned syrup bottle 18 shown in FIG. 2. The syrup tanks S1, S2, and S3 are connected to the valve apparatus 97, respectively.

The carbonated water flows from the carbonator 94 through the pipe 106. The pipe 106 is branched into a plurality of pipe portions which are connected to the carbonated water paths of the valve apparatus 97, respectively.

The refrigerant water tank 87 is provided with an evaporator 108 which extends along an internal surface thereof. As will be known in the art, the evaporator 108 is included in a refrigerant circuit which comprises a compressor 111 and a condenser 112. In this connection, the refrigerant water has a temperature which is controlled in the refrigerant water tank 87 to be about 0° C.

Description will be made about operation of the dispensing unit. When predetermined operation is carried out after a cup 113 is placed on a tray (not shown), the detection switch 42 is operated to thereby actuate both of the pump 82 and the three-way-valve 93. The pump 82 supplies the drinking water to the carbonator 94 and the valve apparatus 97. Responsive to supplying of the drinking water, the carbonator 94 produces the carbonated water to thereby supply the carbonated water to the valve apparatus 97. As a result, the drinking water, the carbonated water, and the syrup are supplied to the valve apparatus.

When the float switch 114 detects a decreasing of a water level in the carbonator 94, the pump 82 is driven to supply the drinking water into the carbonator 94. In this event, the three-way-valve 93 is not driven.

What is claimed is:

1. A mixing apparatus for providing a mixed beverage made of a first, a second, and an additional beverage supplied from a first path, a second path and an additional path, respectively, said mixing apparatus comprising:

a mixing chamber coupled to the paths and having an inner surface defining a mixing space extending along a predetermined axis;

first guiding means coupled to said first path for guiding said first beverage to a first portion of said mixing space to discharge said first beverage therefrom, said first portion being on said predetermined axis;

second guiding means coupled to said second path for guiding said second beverage to a second portion of said mixing space to discharge said second beverage therefrom, said second portion substantially surrounding said predetermined axis, said second path having an outlet opening, wherein said second guiding means comprises:

first receiving means placed to face said outlet opening of the second path for receiving said second beverage to produce a spread beverage; and internal guiding means coupled to said first receiving means for guiding said spread beverage to said second portion of said mixing space;

said second guiding means being supplied with said additional beverage through the additional path which has an additional outlet opening, wherein said second guiding means further comprises a second receiving means placed to face said outlet opening of the additional path for receiving said additional beverage to produce said spread beverage; and discharging means coupled to said mixing chamber for discharging said first, said second, and said additional beverages as said mixed beverage from said mixing space.

2. A mixing apparatus as claimed in claim 1, said second path extending in a predetermined direction, wherein said first receiving means has a flat surface extending perpendicular to said predetermined direction, said flat surface facing said outlet opening of the second path.

3. A mixing apparatus as claimed in claim 1, said additional path extending in a predetermined direction, wherein said second receiving means has an additional flat surface extending perpendicular to said predetermined direction, said additional flat surface facing said additional outlet opening of the additional path.

4. A mixing apparatus as claimed in claim 1, wherein said first guiding means comprises:

a cylindrical portion connected to said first path and extending along said predetermined axis; and local discharging means coupled to said cylindrical portion for discharging said first beverage from said cylindrical portion towards said mixing space.

5. A mixing apparatus as claimed in claim 4, wherein said local discharging means comprises an end portion connected to said cylindrical portion and having a plurality of discharging holes extending in a direction which intersects said predetermined axis, each of said discharging holes discharging said first beverage.

6. A mixing apparatus for providing a mixed beverage made of a first, a second, and an additional beverage supplied from a first path, a second path, and an additional path, respectively, said mixing apparatus comprising:

a mixing chamber coupled to the paths and having an inner surface defining a mixing space extending along a predetermined axis;

first guiding means coupled to said first path for guiding said first beverage to a first portion of said mixing space to discharge said first beverage therefrom, said first portion being on said predetermined axis;

second guiding means coupled to said second path for guiding said second beverage to a second portion of said mixing space to discharge said second beverage therefrom, said second portion substantially surrounding said predetermined axis, said second path having an outlet opening, wherein said second guiding means comprises:

first receiving means placed to face said outlet opening of the second path for receiving said second beverage to produce a spread beverage; and internal guiding means coupled to said first receiving means for guiding said spread beverage to said second portion of said mixing space;

said second guiding means being supplied with said additional beverage through the additional path which has an additional outlet opening, wherein said second guiding means further comprises a second receiving means placed to face said outlet opening of the additional path for receiving said additional beverage to produce said spread beverage; and discharging means coupled to said mixing chamber for discharging said first, said second, and said additional beverages as said mixed beverage from said mixing space;

said first path being placed between said second and said additional paths, wherein a cylindrical portion is between said first and said second receiving means, said internal guiding means comprising:

a plate portion coupled to said first and said second receiving means and having a circular peripheral surface which faces said inner surface of said mixing chamber with a gap left therebetween; and a plurality of projections projected from said circular peripheral surface of said plate portion with a space left between two adjacent ones of said projections.

* * * * *